US005959225A

United States Patent [19]

Hsu

[11] Patent Number: 5,959,225

[45] Date of Patent: Sep. 28, 1999

[54] GUITAR RACK STRUCTURE

[76] Inventor: Hsin-Hsuan Hsu, 11 Kung-5th Rd., Kung-2nd Industrial Zone, Lin-Kou Hsiang, Taipei Hsien, Taiwan

[21] Appl. No.: 09/111,715

[22] Filed: Jul. 8, 1998

[51] Int. Cl.[6] ..... G10D 3/00

[52] U.S. Cl. ..... 84/327

[58] Field of Search ..... 84/327, 421; 248/166, 248/167

[56] References Cited

U.S. PATENT DOCUMENTS 5,505,413 4/1996 Hennessey ..... 248/166

*Primary Examiner*—William M. Shoop, Jr.
*Assistant Examiner*—Shih-yung Hsieh
*Attorney, Agent, or Firm*—Bacon & Thomas, PLLC

[57] ABSTRACT

A guitar rack structure that is composed of a fixing plate and two leg stands, characterized in that: on each of two sides symmetrically arranged below the fixing plate is respectively a reversed-L shaped adjusting hole, on the support rod of each leg stand is respectively a longitudinal through hole corresponding to the adjusting hole, with a shaft rod pulling through the adjusting hole and the through hole, to control the unfolding and folding of the two leg stands; the leg stand comprises a support rod, a bottom rod and a placement rod, at the center of the bottom rod is a connector part, the bottom rod is fitted to the bottom of the support rod by the connector part for its folding purpose; and near the top of the bottom rod on the support rod is fitted a placement rod, the placement rod may be folded upwards. Thus, when the above-mentioned construction is assembled for use, the invention may facilitate the unfolding of the rack, or the rack may be folded to reduce the space for its storage.

2 Claims, 6 Drawing Sheets

GUITAR RACK STRUCTURE

BACKGROUND OF THE INVENTION

The invention relates to a "guitar rack structure", particularly to one with easy folding or unfolding of its leg stands to facilitate its use and reduce the space for its storage.

Conventionally, as illustrated in FIG. 6, a regular guitar rack construction involves mainly two leg stands (a), the top ends of the two leg stands are simultaneously fixed to a fixing plate (b), respectively tightened by a bolt (d) onto the fixing plate (b), so the leg stands (a) may adjust its included angle for fixing purpose, and at an appropriate location below the support rod (a2) of the leg stand (a) is fixed a placement rod (c) that is extended forward and bent upward; thereby the placement rod (c) may accommodate a guitar, and the user may loosen the screw (d) to adjust the included angle of the leg stands (a), to suit various sizes of guitar.

However, said conventional guitar rack construction involves shortcomings, such as, the screw (d) must be loosened before the included angle of the leg stands (a) can be adjusted, which must be tightened after adjustment, so the process is complicated; furthermore, the bottom rod (a1), the support rod (a2) and the placement rod (c) of the leg stand (a) are fixed as one unit which cannot be bent, folded or collapsed, therefore, it will occupy a large space for storage, besides, the packaging and transportation costs for said product shall be significant.

In view of the above shortcomings, the inventor has devoted an extended period of time in research and innovation, and has finally developed and designed a "guitar rack structure".

SUMMARY OF THE INVENTION

The primary objective of the present invention is to present a "guitar rack structure", wherein the leg stands can be easily folded or unfolded, to facilitate use and reduce the space required for its storage and packaging, thus reducing the product's packaging and transportation costs.

To achieve the above objective, the invention comprises two leg stands and a fixing plate, the top ends of said two leg stands are fixed to the fixing plate; characterized in that: on the left and right parts of the bottom of the fixing plate are two symmetrically positioned reversed-L adjusting holes, and on the support rod of each leg stand is respectively a longitudinal through hole corresponding to said adjusting hole, with a shaft rod penetrating said adjusting hole and through hole, to control the unfolding and folding of the leg stands; the leg stand comprises a support rod, a bottom rod and a placement rod, at the center of the bottom rod is a connector part, said bottom rod being fitted by said connector to the bottom of the support rod for its folding purpose; and, on a support rod near the top of the bottom rod is fixed a placement rod, said placement rod may be folded upward.

As said above, wherein the connector part fixed to the center of the bottom rod is welded to the bottom rod by means of two plates, below the two plates in crosswise arrangement are a shaft rod and a stop plate, on top of each of said two joining plates is a corresponding joining hole; on each of bottom edges of two side walls of the support rod is respectively a dent, said dent may be fitted to the shaft rod on the bottom rod, and at an appropriate location on top of said dent is an elongated hole that is corresponding to the joining hole on the connector part on the bottom rod, so a bolt may be inserted to the elongated hole at the bottom of said support rod and the joining hole on the bottom rod to its joining purpose.

The placement rod involves twice bending, backward and inward, at the joining end of an L-shaped rod body, said bent end is inserted to the joining hole below the support rod, on the outside of the L-shaped rod body is a soft sleeve to accommodate a guitar, and at an appropriate location on top of the joining hole of said support rod is fixed a screw.

To enable further understanding of the integral configuration, installation, characteristics and performances of the present invention, the embodiment of the present invention is described in details accompanied by drawings below:

DETAILED DESCRIPTION OF PREFERRED EMBODIMENT

Figure 1:
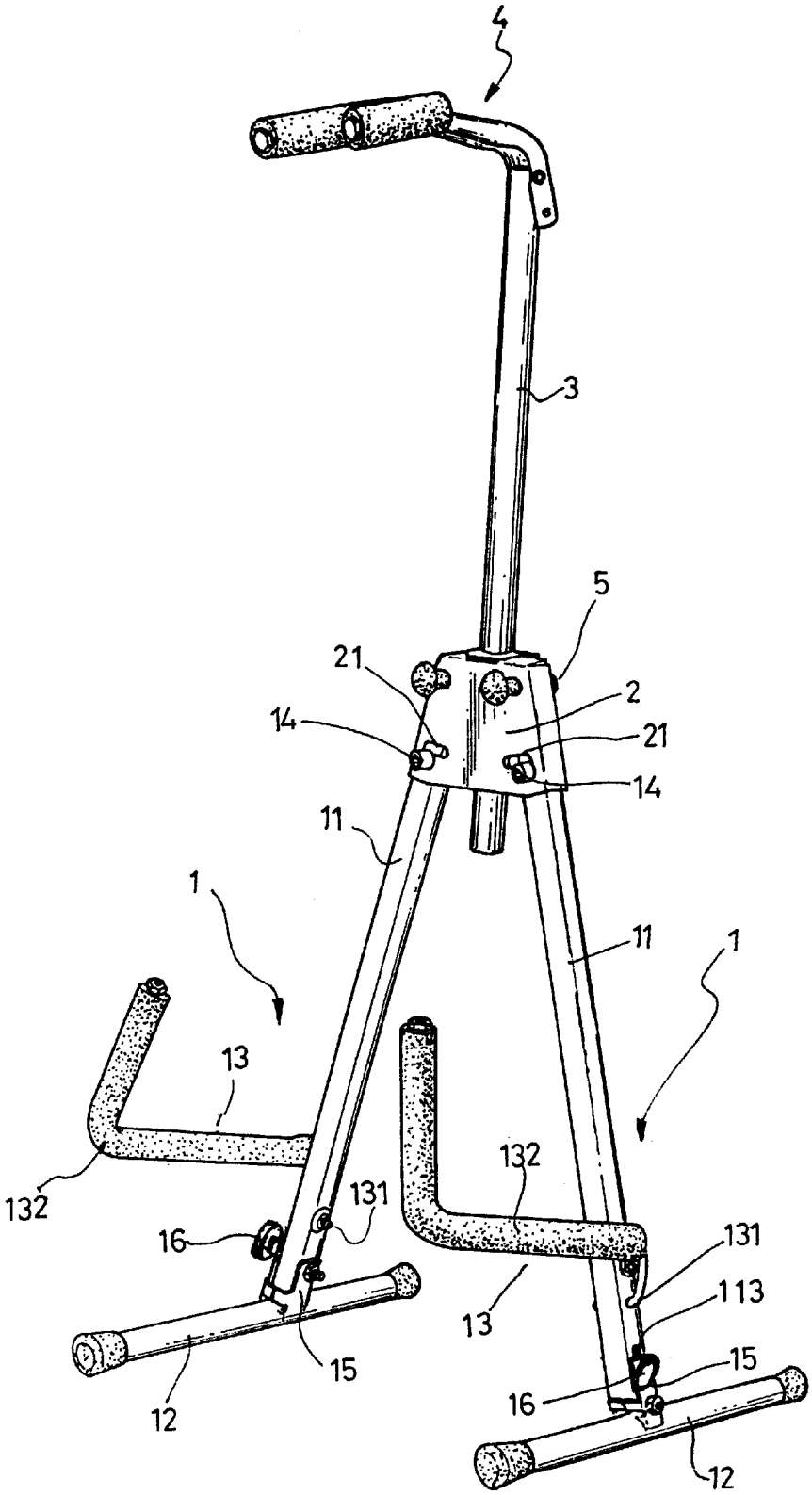
FIG. 1 is an erected view of the invention.
Figure 2:
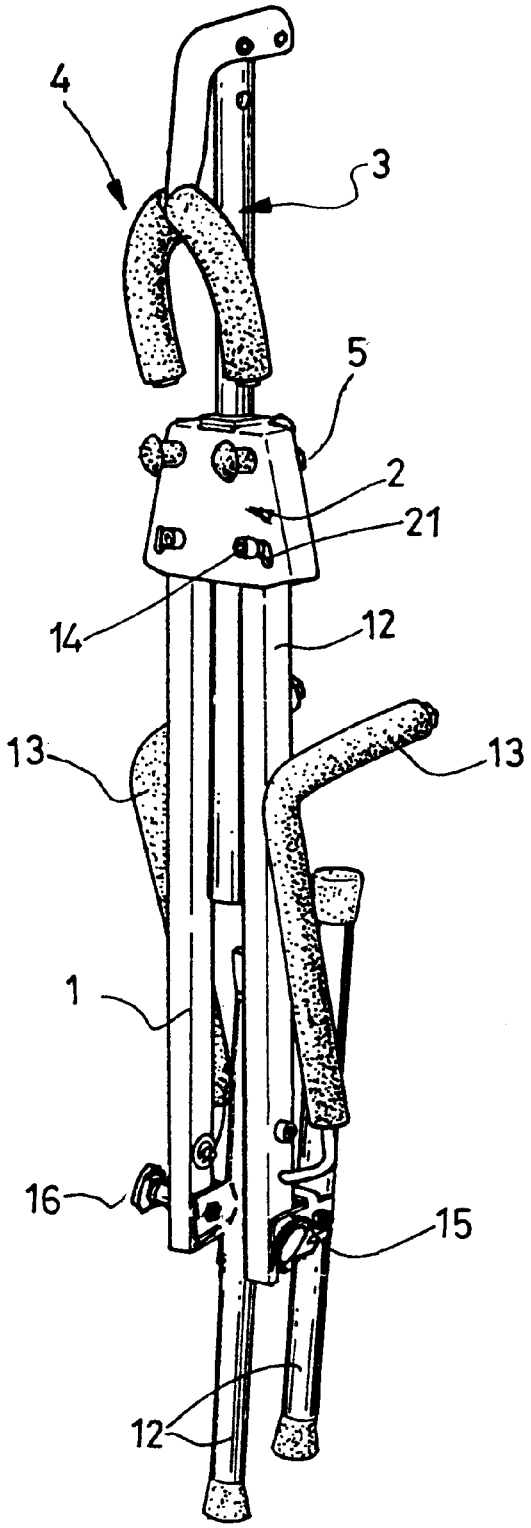
FIG. 2 is a collapsed view of the invention.
Figure 3:
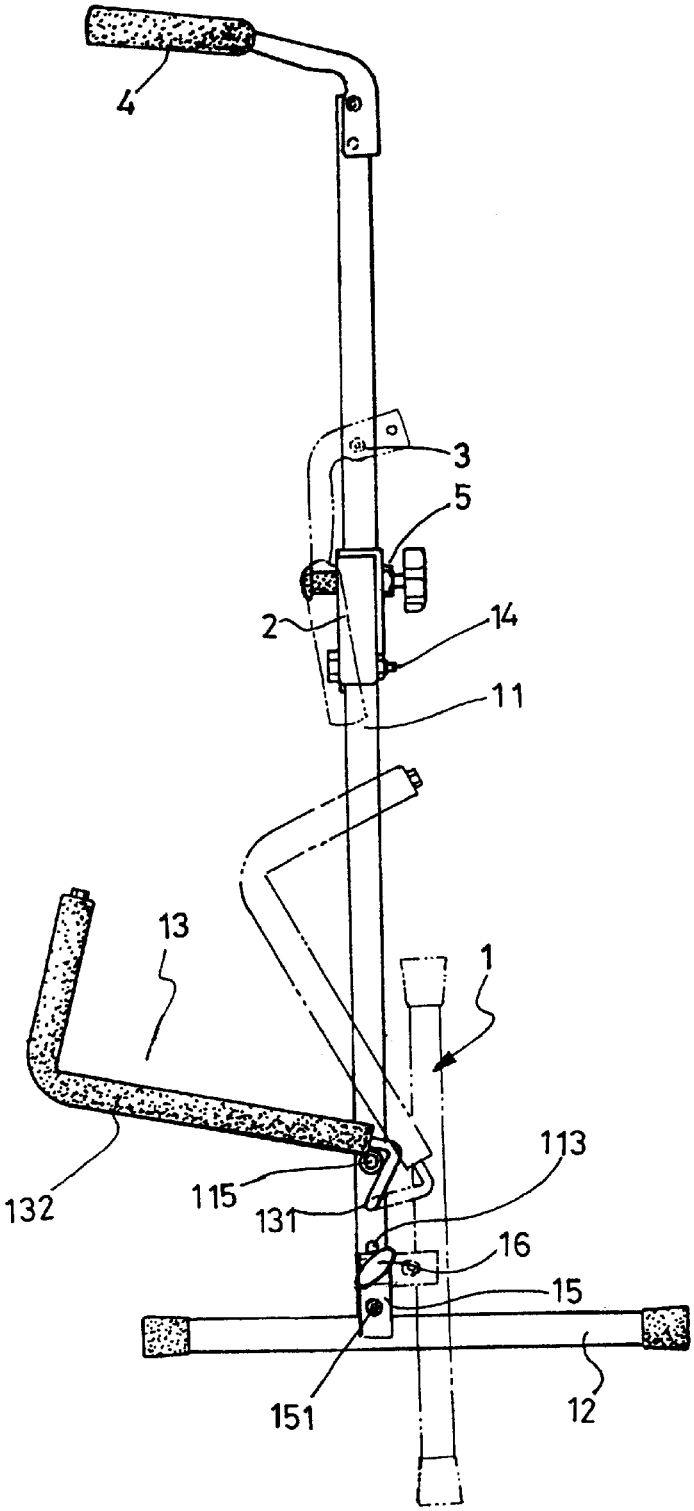
FIG. 3 is an embodiment side view of the invention in erecting/collapsing operation.

Please refer to FIGS. 1 through 4, the "guitar rack structure" comprises two leg stands 1 and a fixing plate 2, each of said two leg stands 1 is respectively tightened by a screw 5 onto the right and left parts of the fixing plate 2, and in the embodiment there is an additional fitting of a length-adjustable upright rod 3 onto the fixing plate 2, then to the top end of said upright rod 3 is fixed a Y-fork 4; therefore, in the embodiment view, the upright rod 3 is length-adjustable and the Y-fork 4 is foldable, FIGS. 2 and 3 illustrate its collapsed condition, so that it may be conveniently stored and its packaging measurements can be reduced, whereby the height of the upright rod 3 can be adjusted to accommodate guitars of various measurements.

Figure 4:
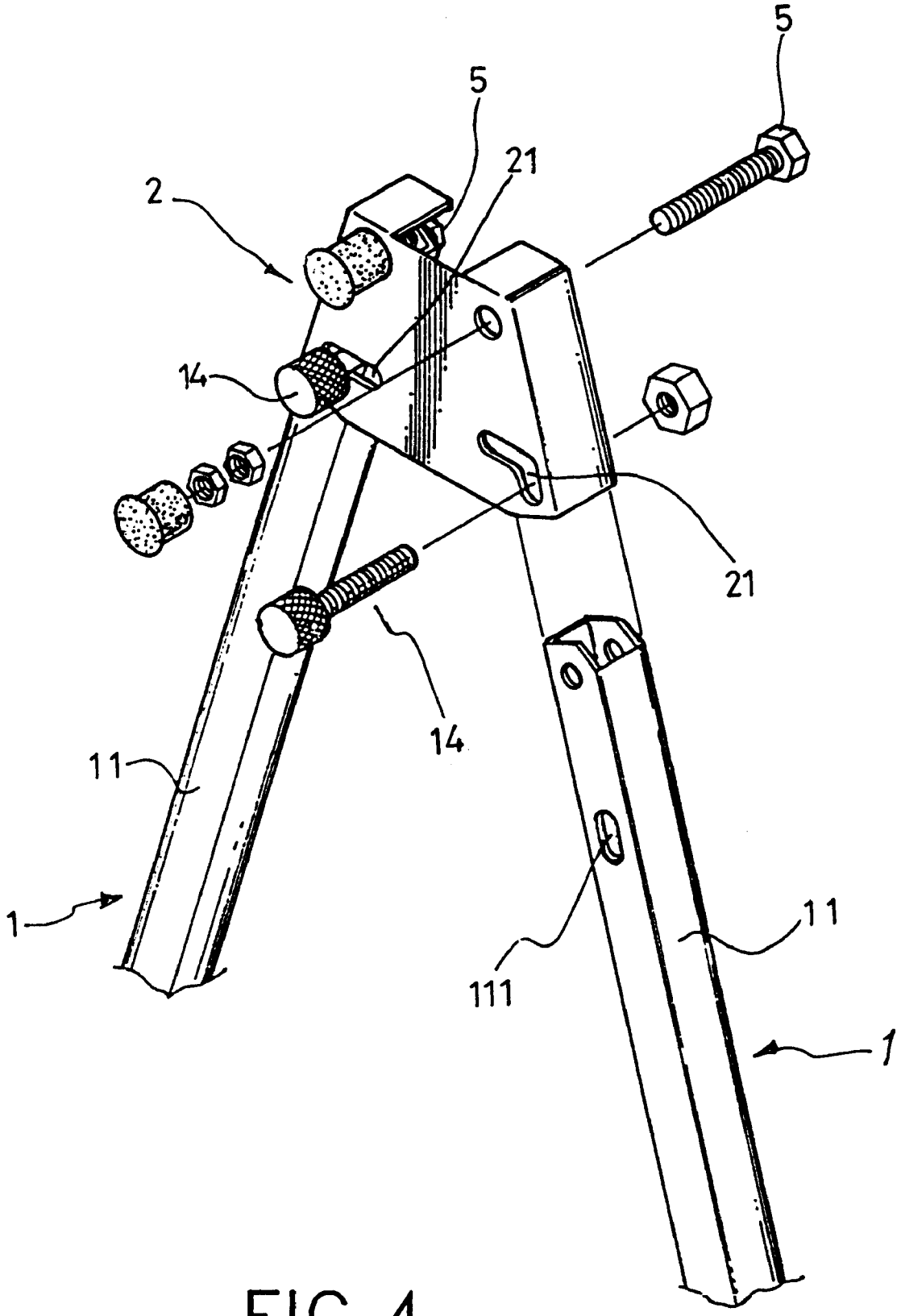
FIG. 4 is an embodiment view of the fang plate in application of the invention.

The invention is characterized in that: on the left and right sides below the fixing plate 2 is respectively a reversed-L shaped adjusting hole 21 in symmetrical arrangement, on the support rod 11 of each leg stand 1 corresponding to said adjusting hole 21 is a longitudinal through hole 111, then a first shaft rod 14 is inserted in said adjusting hole 21 and the through hole 11 1, to control the unfolding and folding of the two leg stands (as shown in FIG. 4); to fold the leg stands 1, all the user has to do is to pinch the two ends of the shaft rod with the user's thumb and index finger, lift it and push it in the path of the reversed-L shaped adjusting hole 21; to unfold it, just pull open the bottom ends of the two leg stands 1; furthermore, the shaft rod 14 in the embodiment, view is a screw structure, while the nut on the other end is used to prevent said first shaft rod 14 from loosening, so it is fastened to the extent that it will not lock the fixing plate 2 and the leg stands 1.

The leg stands 1 are composed of the support rods 11, bottom rods 12 and placement rods 13, at the center of the bottom rod 12 is a connector part 15, said bottom rod 12 is joined by said connector part 15 to the bottom end of the support rod 11 for its folding purpose; over the bottom rod 12 on said support rod 11 is fitted a placement rod 13, said placement rod 13 may be folded upwards.

Figure 5:
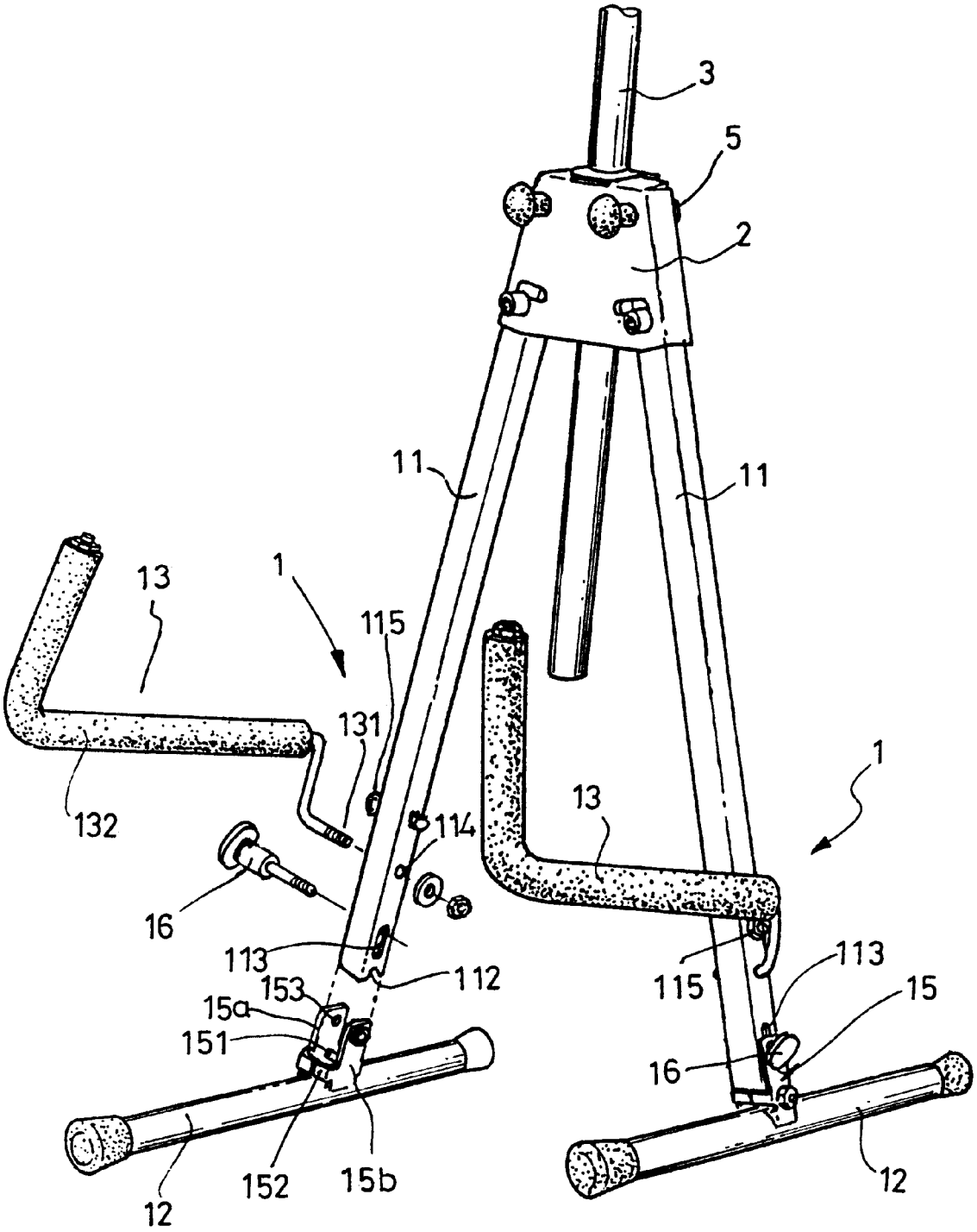
FIG. 5 is an exploded view of the leg stand of the invention.
Figure 6:
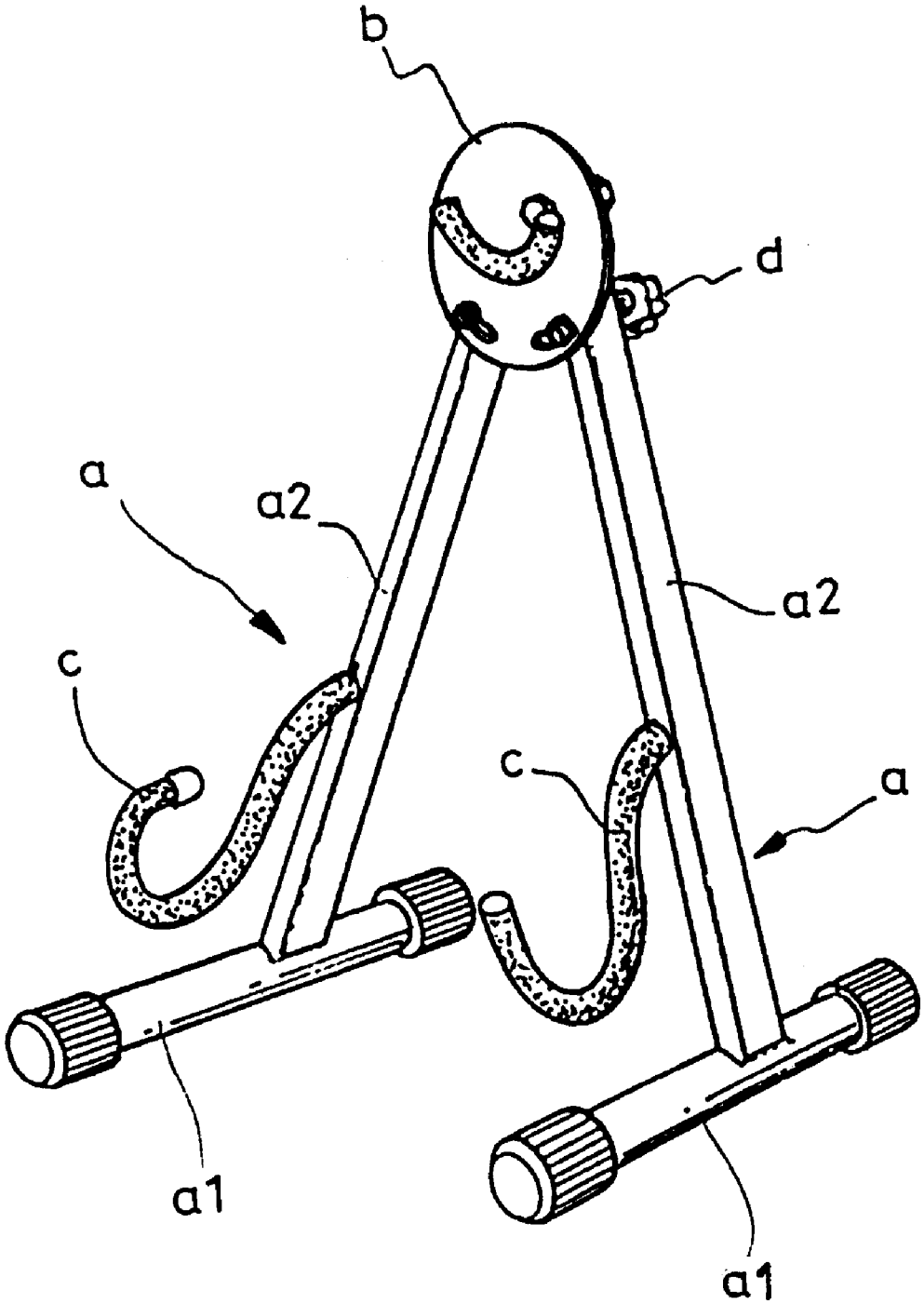
FIG. 6 (PRIOR ART)
FIG. 6 is a perspective view of a prior art.

As shown in FIG. 5, the connector part 15 at the center of the bottom rod 12 is fixed by two plates 15*a* and 15*b* in a welding process onto the bottom rod 12, and to the bottom of the two plates 15*a* and 15*b* are fitted crosswise a second shaft rod 151 and a stop plate 152, and the top of the two connector plates 15*a* and 15*b* are respectively a joining hole 153 that corresponds to each other, The support rod 11, on each of the bottom edges on two side walls is resectively a dent 112, said dent 112 may be fitted to the second shaft rod 151 on the bottom rod 12, and at an appropriate location on the top of said dent 112 is an elongated hole 113 that corresponds to the joining hole 153 on the connector part 15 on the bottom rod, whereby a bolt 16 may be inserted through the elongated hole 113 at the bottom of said support rod and the joining hole 153 on the bottom rod;

The placement rod 13, an L-shaped rod body which joining end 131 is subjected to twice bending to the back and to the inside, said bent end is joined to the joining hole 114 at the bottom of the support rod 11, on the outside of the L-shaped rod body is a soft sleeve 132 to hold the guitar, and at an appropriate location on top of the joining hole 114 of said support rod 11 is fixed a screw 115, when the placement rod 13 is lowered, it will rest on top of said screw 115.

When the aforementioned structure is assembled for ready urge, the dent at the bottom of the support rod will be caught by the second shaft rod 151 of the connector part, and rest on the stop plate 152, so the bottom rod 12 and the support rod 11 can be securely assembled; to fold it, first the bolt 16 is loosened, then the bottom rod 12 is pulled down, so said dent 112 is disengaged from the second shaft rod 151, then the bottom rod 12 is bent to the other direction of the stop plate 152, thus it is conveniently folded; and, in said embodiment view, the bolt end of said bolt 16 is fitted with an oval handle 161 to facilitate operation.

Based on the above construction, the objective of the invention is to reduce the space occupied when it is folded for storage, and so with its effects of convenient storage and reduced packing measurements, the invention has its applicability and originality, and, since the invention has never been seen in any publications, it will certainly satisfy the requirements for a patent right.

But the above description, covering only the preferred embodiment of the present invention, should not be based to limit or restrict the subject claim. All equivalent structural and/or configurational variations and/or modifications deriving from the subject description with drawings herein shall reasonably be included in the intent of the subject claim.

I claim:

1. A guitar rack structure, comprising two leg stands and a fixing plate, said two leg stands being fitted to the fixing plate; characterized in that:

respectively on each of two sides at the bottom of said fixing plate being symmetrically arranged a reversed-L shaped adjusting hole, on the support rod of each said leg stand respectively corresponding to said adjusting hole being a longitudinal through hole, with a first shaft rod penetrating said adjusting hole and through hole, to control the unfolding and folding of said two leg stands; said leg stand comprising a support rod, a bottom rod and a placement rod, at the center of said bottom rod being a connector part, said bottom rod being fitted to the bottom of said support rod by said connector part for its folding purpose; and near the top of said bottom rod on said support rod being fitted said placement rod, said placement rod may be folded upwards.

2. The guitar rack structure, as recited in claim 1, wherein said connector part at the center of said bottom rod of said leg stand is fixed by two plates in a welding process to said bottom rod, on the bottom of said two plates in crosswise arrangement being a second shaft rod and a stop plate, and on the top of each of said two connecting plates being a corresponding joining hole;

on each of the bottom edges of two side walls of said support rod being a dent, said dent may be fitted to said second shaft rod on said bottom rod, and at an appropriate location on the top of said dent being an elongated hole that is corresponding to said joining hole on said connector part on said bottom rod, so that a bolt may be inserted to said elongated hole on the bottom of said support rod and said joining hole on said bottom rod for its connecting purpose;

said placement rod, an L-shaped rod body with its joining end being subjected to twice bending backward and inward, said bent end being inserted to a joining hole at the bottom of said support rod; at an appropriate location on top of said joining hole of said support rod being fixed a screw, so designed that when said placement rod is lowered, it will justly rest on said screw.

* * * * *